United States Patent [19]

Goldberg

[11] 4,352,536

[45] Oct. 5, 1982

[54] PRINTED CIRCUIT BOARD CONNECTING AND LOCKING ASSEMBLY

[75] Inventor: Gerald J. Goldberg, Palm Beach Gardens, Fla.

[73] Assignee: Harris Data Communications, Inc., Dallas, Tex.

[21] Appl. No.: 128,142

[22] Filed: Mar. 7, 1980

[51] Int. Cl.[3] ..... H01R 13/64

[52] U.S. Cl. ..... 339/75 MP; 339/186 M

[58] Field of Search ..... 339/75 MP, 189 M, 186 M

[56] References Cited

U.S. PATENT DOCUMENTS

| | | | |
|---|---|---|---|
| 2,958,014 | 10/1960 | Blain | 339/75 MP |
| 3,180,598 | 6/1965 | Pferd | 339/75 MP X |
| 3,818,280 | 6/1974 | Smith et al. | 339/189 M X |
| 3,853,379 | 12/1974 | Goodman et al. | 339/75 MP |

*Primary Examiner*—Eugene F. Desmond

*Attorney, Agent, or Firm*—Antonelli, Terry & Wands

[57] ABSTRACT

A printed circuit board connecting and locking assembly, particularly for use in conjunction with zero entry force connectors, is designed to prevent insertion of a printed circuit board into a closed zero entry force connector, to ensure that the printed circuit board is properly seated into the connector before it can be closed, enable a keying of the printed circuit boards so that only the printed circuit board having the proper key can be inserted, and ensure that the printed circuit board, once inserted, is securely locked in place. To this end, according to a preferred embodiment, at least one circuit board locking key is carried by a support for movement between a first, open position located outside of an insertion and removal path of a printed circuit board into and out of an electrical connector and a second, closed position located within the path of the printed circuit board, an actuator rod being mounted for reciprocation parallel to the path of the circuit board so that a camming surface thereof will displace the locking key transversely of the circuit board path from the first, open position into the second, closed position. Either a spring or a further camming action can be utilized for retraction of the locking key.

18 Claims, 12 Drawing Figures

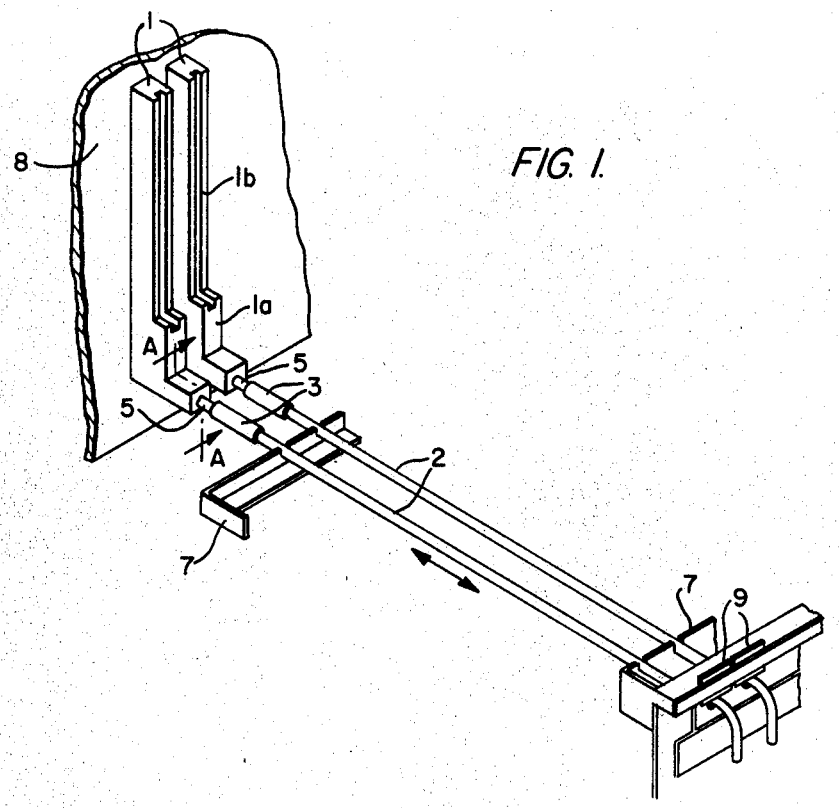
FIG. 1.
FIG. 2.
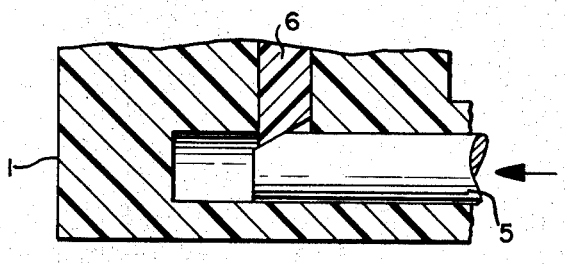
FIG. 3.
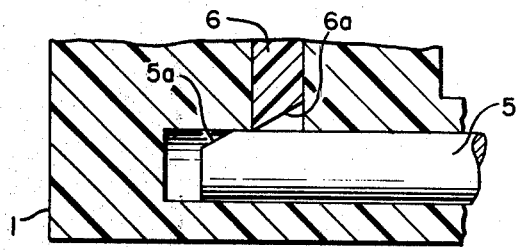
FIG. 4a.
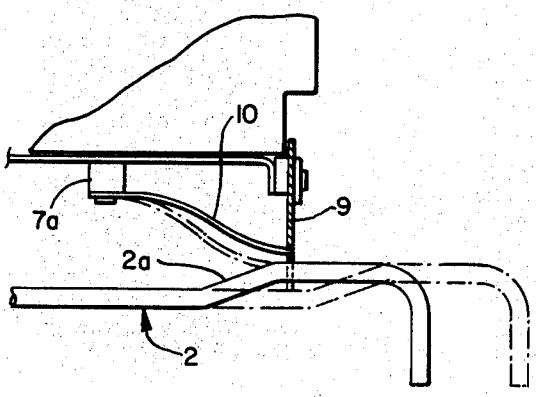
FIG. 4b.
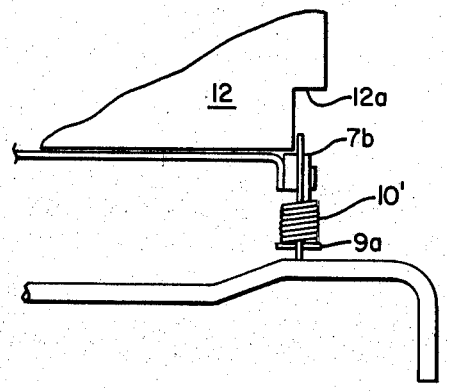

PRINTED CIRCUIT BOARD CONNECTING AND LOCKING ASSEMBLY

BACKGROUND OF THE INVENTION

1. Field of the Invention

The present invention relates generally to a printed circuit board connecting and locking assembly and, more particularly, to an assembly for use in conjunction with zero insertion force connectors.

2. Description of the Prior Art

Computer technology has made extensive use of printed circuit boards for mounting complete modular circuits. However, conventional circuit board connectors posed problems due to the excessive amount of force required for effectuating the connection between the printed circuit board and the connector. To avoid these problems, zero or low insertion force connectors (hereinafter ZIF connectors) have been developed which impose substantially no force upon the electrical contacts of the circuit board and connector during insertion of the printed circuit board into electrical engagement with the ZIF connector. U.S. Pat. No. 4,076,362 is representative of one of the large number of such ZIF connectors.

While such ZIF connectors have proven greatly advantageous over conventional plug-in contacts, they have not been without problems themselves. In many installations, it is difficult, if not impossible, to visually determine whether or not the ZIF connector is in its open position, its closed position, or some position inbetween. This can result in damage to the printed circuit board if an attempt is made to insert it into a closed ZIF connector or can result in disengagement of the electrical contacts if the disconnector is not properly closed after insertion of the circuit board. Furthermore, since the electrical contacts are not clearly visible in ZIF connectors and since they are often capable of accepting various contact arrangements, a problem results in that a technician could inadvertently install the wrong circuit board in a particular connector.

To avoid the problem of a circuit board becoming disengaged from its connector, various circuit board locking clips and connector arrangements are known such as from U.S. Pat. Nos. 4,017,138; 3,970,353; and 3,954,242, while U.S. Pat. No. 3,853,379 shows a printed circuit board connector assembly wherein circuit board locking latches are connected to an actuating rod for opening and closing ZIF connector contacts so as to enable insertion and withdrawal of the printed circuit board into and out of the contacts of the ZIF connector only when they are in their open or inactive position.

However, none of these above-noted patents describe a printed circuit board connecting and locking assembly which is able to ensure that only the correct circuit board is inserted into a particular ZIF connector in a simple manner while still achieving all of the beneficial attributes of such arrangements with respect to secure fastening of the circuit board in place and ensuring that insertion and withdrawal of the circuit board occurs only when the ZIF connectors are in their open position.

SUMMARY OF THE INVENTION

In accordance with the present invention, a printed circuit board connecting and locking assembly is provided in which one or more printed circuit boards may be mounted in a supporting frame. A mechanism that serves to retain a printed circuit board in a channel or guide when using a ZIF connector acts to prevent insertion of a printed circuit board into a closed ZIP connector, and will ensure that the proper printed circuit board is inserted and properly seated into the connector before it can be actuated into its closed position. In particular, the connector actuator according to a preferred embodiment uses a reciprocable actuating rod with a camming configuration to cause displacement of a locking bar or key to or from a first position (wherein the ZIF connector is open and the locking key is retracted) permitting insertion of the proper printed circuit board and a second position wherein the locking key is displaced so as to either block insertion of a printed circuit board into a guide, or secure the correct printed circuit board in place (closed position).

By providing each locking key with a different printed circuit board engaging formation for matingly engaging with a complimentarily shaped formation on a printed circuit board to be locked thereby, improper matching of printed circuit boards with the electrical connectors is precluded. These formations can be a series of cut outs or projections on the key which mate with notches or apertures formed at or near a rear edge of the circuit board.

Thus, it is an object of the present invention to provide a simple constructional arrangement which avoids the problems attendant to the use of printed circuit boards and in particular printed circuit boards in conjunction with ZIF connectors by assuring that printed circuit boards are properly locked in place within their connector, preventing insertion of a printed circuit board into a closed ZIF connector, preventing actuation of the connector into its closed position with an improper circuit board and providing a capability for preventing mismatching of circuit boards with connectors in which they are mountable.

These and further objects, features and advantages of the present invention will become more obvious from the following description when taken in connection with the accompanying drawings which show, for purposes of illustration only, several embodiments in accordance with the present invention.

BRIEF DESCRIPTION OF THE DRAWINGS

FIG. 1 is a partial schematic view illustrating a preferred embodiment of a printed circuit board connecting and locking assembly in connection with the present invention;

FIG. 2 is a partial sectional view taken along line A—A of FIG. 1 showing an actuating rod operating to shift a ZIF connector from its open position into a closed position;

FIG. 3 is a view similar to FIG. 2 and shows the position of the actuator rod when the ZIF connector is in its closed position;

DESCRIPTION OF THE PREFERRED EMBODIMENT

Figure 4C:
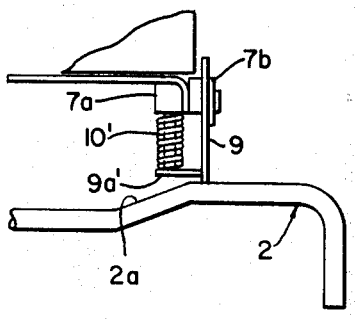
FIGS. 4(*a*) through (*c*) illustrate alternative arrangements for displacing a locking key from a blocking to a non-blocking position.

With reference to FIG. 1, a preferred embodiment of a printed circuit board connecting and locking assembly in accordance with the present invention is shown which includes ZIF connectors 1 which are coupled to actuator rods 2 via couplers 3. The ZIF connectors can be of any suitable conventional type that has a connector opening and closing operator that is reciprocable in a direction parallel to the direction of insertion of a printed circuit board into the ZIF connector.

FIGS. 2 and 3 show one conventional ZIF connector operating arrangement wherein a connector operating rod is provided with a cam surface which co-acts with a cam surface 6*a* of a connector contact shifting slide 6 such that upon displacement of the connector operating rod 5 in the direction shown by the arrow in FIG. 2 (in response to reciprocation of the actuator rod 2 coupled to rod 5 via coupler 3) the slide 6 is displaced transversely so as to cause displacement of the contacts from an open position wherein a printed circuit board can be received and a closed position wherein the contacts are brought into engagement with contacts upon the printed circuit board. Since the details of the ZIF connector contacts and the mechanism for shifting same form no part of the invention themselves and numerous types of such ZIF connectors are well known to those of ordinary skill in the art, the details thereof have been omitted from the drawings.

The actuating rods 2 are carried upon a support frame 7 which is provided with notches which permit reciprocation of the actuating rods 2 in the directions of the double headed arrow in FIG. 1 for actuating the ZIF connector operating rod as noted above. The support frame as well as the ZIF connectors can be mounted within a drawer or cabinet 8 of a computer.

The frame 7 also carries a plurality of locking keys 9, equal in number to the ZIF connectors and actuating rods, in a manner displaceable in directions transverse to the double headed arrow in FIG. 1. These keys 9 are held out of the path of insertion of a printed circuit board by either a flat spring 10 (FIG. 4*a*) or a coil spring 10' (FIGS. 4*b* and 4*c*) interconnected between a spring retainer 7*a* on the support frame 7 or key cover 7*b* connected thereto and an abutment support pin 9*a*, 9'*a* carried by the locking key 9. However, FIGS. 5*a*, *b* show a most preferred arrangement which utilizes a camming action of the actuator rod itself (discussed in further detail below) to produce displacement of keys 9.

It should be recognized that circuit board guides 11 are mounted in association with each of the ZIF connectors 1 so as to extend from their surface 1*a* parallel to the actuator rods 2. These guides 11 are provided with a slot which permits a printed circuit board to be slid therealong into the slot 1*b* of the ZIF connector. As can be seen from FIG. 5(*a*), when an actuating rod 2 is pulled outwardly, locking key 9 is at a lowered position providing free access for the printed circuit board into the guide slot of guide 11 for insertion into the ZIF connector which has been opened under action of the actuating rod pulling the connector operating rod 5 so as to cause displacement of the ZIF connector contacts into their open position. When the proper printed circuit board 12 is fully seated within the ZIF connector 1, pushing of the actuating rod 2 to its FIG. 5(*b*) position can be achieved. In this position, the actuating rod 9 causes closing of the contents of the ZIF connector into electrical engagement with the contacts of the printed circuit board and the locking key 9 having traveled up the upper camming surface 2*a* of the hook-shaped end 2*b* of the actuating rod 2 is brought into position within a notch, key or slot 12*a* in the printed circuit board, locking same in place by blocking its path of movement from the ZIF connector.

Figure 5A:
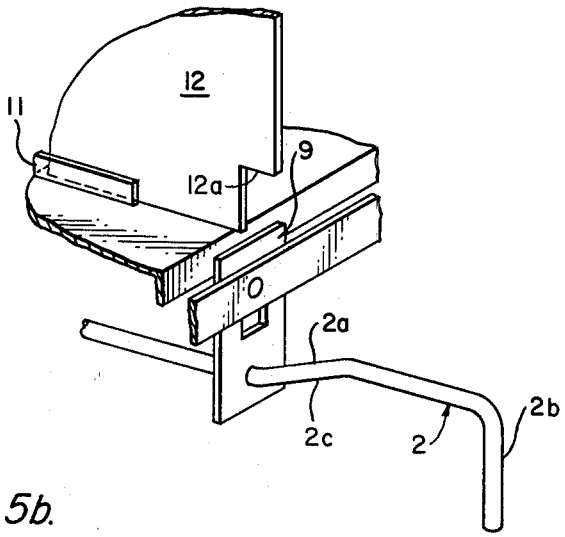
FIGS. 5(*a*) and (*b*) are partial schematic illustrations of an actuating rod, key and circuit board in their insertion and locked positions of a most preferred arrangement for displacing the locking key between blocking and non-blocking positions.
Figure 5B:
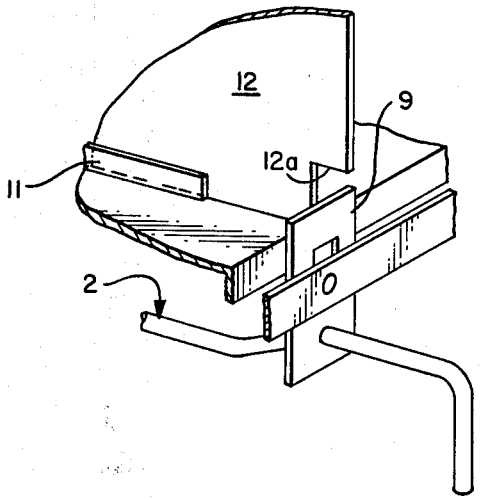

When a return spring 10 or 10' is used to return the locking key 9 to its lowered position upon the actuating rod being pulled out again, it is sufficient for the locking key to merely rest upon the upper camming surface 2*a* of the end 2*b* of the actuating rod 2. However, as noted above, the actuating rod can be utilized to positively displace the locking key in both its upward and downward directions by having the actuating rod 2 pass through an aperture in the locking key whereby lowering of key 9 is produced by a lower camming surface 2*c*. In FIGS. 5*a*, *b* such an embodiment is shown with the locking key and actuating rod in their open and closed positions, respectively.

The use of locking keys 9 as described above provides the additional advantage that they can be shaped so as to correspond in shape to the shape of the notch, key or slot 12*a* located at or near the rear edge of the printed circuit board such that each of a plurality of circuit boards and keys can be provided with a different shape so that the actuating rod cannot be displaced so as to close the ZIF connector if the wrong printed circuit board is inserted. For example, FIGS. 6(*a*) through (*d*) show four sets of circuit board/locking key configurations which will permit mating of the proper locking key with the proper circuit board, but (as the center lines shown thereon indicate) are designed such that a locking key configured as in the lower FIG. 6(*b*) set cannot be displaced upwardly into the cutout of the upper FIG. 6(*c*) configuration.

Figure 6:
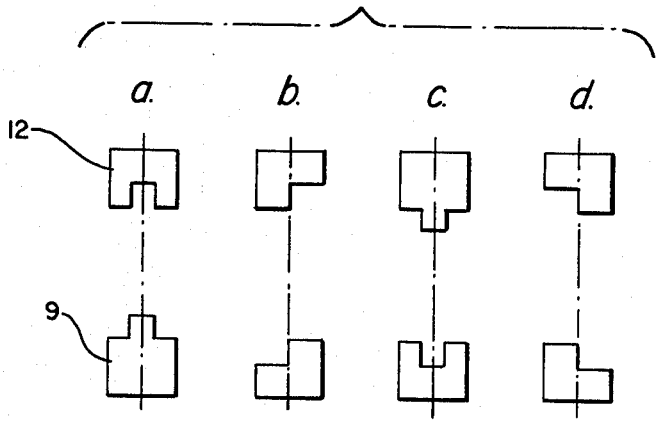
FIGS. 6(*a*) through (*d*) illustrate four keying configurations for use on locking keys and circuit boards in accordance with the present invention.

It should also be appreciated that the configuration shown in FIGS. 6(*a*) through (*d*) can be rotated by 90° and the keys 9 and actuating rods 2 rotated by 90° relative to the major plane of the printed circuit board such that the key engages in the board's major surface as opposed to its side or rear edge. Still further, since the keying notch or slot in the printed circuit board is located only near its rear edge, should an attempt be made to insert a circuit board into a closed ZIF connector (FIG. 5*b* position), the raised locking key will block access to the slot of the guide 11 so that the actuating rod will have to be pulled to its open position (thereby opening the ZIF connector) before the circuit board can be successfully inserted into the guide and ZIF connector with the result that damage to the contacts of the printed circuit board and ZIF connector can be avoided.

From the foregoing, it can be seen that the present invention provides a four-fold function with respect to its use in conjunction with conventional ZIF connectors in that: (1) a printed circuit board 12 can be retained securely within a ZIF connector 1 by the locking key 9; (2) the locking key 9 prevents insertion of a printed circuit board into a closed ZIF connector since the actuating rod 2 causes simultaneous operation of the ZIF connector and locking key so that they are either both open or both closed; (3) with use of a locking key which can only mate with a key on the printed circuit board when the board is fully inserted within the ZIF connector, proper seating of the printed circuit board within the ZIF connector can be assured before actuation thereof is achieved; and (4) by matching the configuration on each locking key with a complementary formation provided only on circuit boards intended for use with the ZIF connector that the particular key is mounted in association with, closing of a ZIF connector with an improper printed circuit board inserted therein can be prevented.

While I have shown and described several embodiments in accordance with the present invention, it is understood that the same is not limited thereto but is susceptible of numerous changes and modifications as known to those skilled in the art and I therefore do not wish to be limited to the details shown and described herein but intend to cover all such changes and modifications as are encompassed by the scope of the appended claims.

What is claimed is:

1. A printed circuit board connecting and locking assembly comprising:

(a) at least one electrical connector for receiving a printed circuit board in electrical engagement therewith;

(b) a support structure;

(c) at least one circuit board locking key supported at least in part by said support structure for movement between a first, open position located outside of an insertion and removal path of said printed circuit board into and out of said electrical connector and a second, closed position located within said path of the printed circuit board into and out of the electrical connector; and (d) at least one actuator rod mounted in association with said electrical connector for reciprocation, said actuator rod extending in an axial direction from said electrical connector beyond said locking key and being provided with an axially extending camming surface for displacing said locking key from said first, open position to said second, closed position.

2. A printed circuit board connecting and locking assembly according to claim 1, wherein said electrical connector is of the zero insertion force type and said actuator rod is operatively coupled thereto for placing said electrical connector in an open printed circuit board receiving condition when moved to a position where said locking key is in its first, open position and for placing said electrical connector in a closed printed circuit board engaging position when moved to a position where said locking key is in said second, closed position, whereby insertion of a printed circuit board into a closed electrical connector is precluded.

3. A printed circuit board connecting and locking assembly according to claim 1 or claim 2, wherein said actuator rod has a second camming surface for displacing said locking key from said second, closed position to said first, open position.

4. A printed circuit board connecting and locking assembly according to claim 3, wherein said locking key is a plate reciprocably displaceably carried by said support structure, said plate having an aperture corresponding in configuration to the cross section of said actuator rod and through which said actuator rod extends.

5. A printed circuit board connecting and locking assembly according to claim 1 or claim 2, wherein said actuator rod is mounted to said support structure for movement substantially parallel to said path of the printed circuit board and said locking key is supported by said support structure so as to be movable transversely to said path.

6. A printed circuit board connecting and locking assembly according to claim 1, comprising spring means for biasing said locking key from said second, closed position to said first, open position.

7. A printed circuit board connecting and locking assembly according to claim 1, comprising a plurality of each of said electrical connector, circuit board locking key and actuator rod, a respective circuit board locking key and actuator rod being associated with each electrical connector.

8. A printed circuit board connecting and locking assembly according to claim 7, wherein each locking key has a different shape representing a printed circuit board engaging formation for matingly engaging a complementarily shaped formation on a printed circuit board to be locked thereby, whereby improper matching of printed circuit boards with the electrical connectors is precluded.

9. A printed circuit board connecting and locking assembly according to claim 8, wherein said locking key is in the form of a plate positioned in a plane transverse to said insertion and removal path of the printed circuit board and having selective cut-out portions forming said engaging formation.

10. In a printed circuit board connecting and locking assembly of the type having at least one zero insertion force electrical connector for receiving a printed circuit board in electrical engagement therewith, a reciprocable actuator rod for shifting said electrical connector between a first, open position and a second, closed position, and locking means engageable with said printed circuit board and coordinated to movement of said actuator rod for retaining said printed circuit board within said electrical connector when said connector is in its closed position, the improvement comprising key means displaceable by said actuator rod and engageable with said circuit board for forming said locking means, preventing insertion of the printed circuit board into the electrical connector when it is in its closed position, preventing closing of the electrical connector when the circuit board is only partially inserted or is improperly seated within the electrical connector and ensuring that only circuit boards intended for use with said electrical connector can be inserted therein, wherein each actuator rod includes a camming surface and said key means includes a locking key in sliding contact with said camming surface for linear movement into said insertion and removal path of the printed circuit board by reciprocation of said actuator rod.

11. A printed circuit board connecting and locking assembly according to claim 10, comprising a plurality of each of said electrical connector, key means, and actuator rod, a respective key means and actuator rod being associated with each electrical connector, each key means having a different shape representing a printed circuit board engaging formation for matingly engaging a complementary shaped formation on a printed circuit board to be locked thereby, whereby improper matching of printed circuit boards with the electrical connectors is precluded.

12. A printed circuit board connecting and locking assembly according to claim 10, wherein said locking key is in the form of a plate positioned in a plane transverse to said insertion and removal path of the printed circuit board and having selective cut-out portions forming said engaging formation.

13. A printed circuit board connecting and locking assembly according to claim 10, wherein said actuator rod has a second camming surface for displacing said locking key away from said insertion and removal path.

14. A printed circuit board connecting and locking assembly according to claim 13, wherein said locking key means is a plate reciprocably displaceably carried by said support structure, said plate having an aperture corresponding in configuration to the cross-section of said actuator rod and through which said actuator rod extends.

15. A printed circuit board connecting and locking assembly according to claim 10, further including means for biasing said locking key from said closed position to a position out of said insertion and removal path.

16. A printed circuit board connecting and locking assembly comprising:

(a) at least one electrical connector for receiving a printed circuit board in electrical engagement therewith:

(b) a support structure;

(c) at least one circuit board locking key supported at least in part by said support structure for movement between a first, open position located outside of an insertion and removal path of said printed circuit board into and out of said electrical connector and a second, closed position located within said path of the printed circuit board into and out of the electrical connector;

(d) at least one actuator rod mounted in association with said electrical connector for reciprocation, said actuator rod extending in an axial direction from said electrical connector beyond said locking key and being provided with an axially extending camming surface for displacing said locking key from said first, open position to said second, closed position; and (e) comprising spring means for biasing said locking key from said second, closed position to said first, open position.

17. A printed circuit board connecting and locking assembly according to claim 5 or 16, wherein said spring means is a flat spring.

18. A printed circuit board connecting and locking assembly according to claim 4 or 16, wherein said spring means is a coil spring.

* * * * *